United States Patent [19]

Haeussler et al.

[11] Patent Number: 4,962,795

[45] Date of Patent: Oct. 16, 1990

[54] SPRING MOUNTING FOR THE WEFT THREAD INLET END OF THE MAIN NOZZLE OF AN AIR JET LOOM

[75] Inventors: Horst Haeussler, Lindau; Othmar Oppl, Hergensweiler, both of Fed. Rep. of Germany

[73] Assignee: Lindauer Dornier Gesellschaft m.b.H., Bodensee, Fed. Rep. of Germany

[21] Appl. No.: 346,892

[22] Filed: May 2, 1989

[30] Foreign Application Priority Data

May 4, 1988 [DE] Fed. Rep. of Germany ..... 3815088

[51] Int. Cl.[5] ..... D03D 47/30

[52] U.S. Cl. ..... 139/435.4

[58] Field of Search ..... 139/435 C

[56] References Cited

U.S. PATENT DOCUMENTS 4,448,223 5/1984 Deborde et al. ..... 139/435

4,565,226 1/1986 Tsuji ..... 139/435

4,644,980 2/1987 Mitsuya et al. ..... 139/435

4,703,778 11/1987 Wulf ..... 139/435

FOREIGN PATENT DOCUMENTS 3014776 11/1980 Fed. Rep. of Germany .

211655 11/1984 Japan ..... 139/435

*Primary Examiner*—Andrew M. Falik

*Attorney, Agent, or Firm*—W. G. Fasse; D. H. Kane, Jr.

[57] ABSTRACT

The main nozzle of an air jet loom has an inlet end (7) where the weft threads are inserted into the main nozzle and exits (19) where the weft threads pass out of the main nozzle into the weft thread air insertion channel (20) of the reed (14). The inlet end (7) is supported by a spring elastic mounting which permits guided movements of the nozzle exits (19) in any direction in a plane extending perpendicularly to the weft thread insertion direction for properly aiming a nozzle exit into the air insertion channel.

6 Claims, 2 Drawing Sheets

SPRING MOUNTING FOR THE WEFT THREAD INLET END OF THE MAIN NOZZLE OF AN AIR JET LOOM

FIELD OF THE INVENTION

The invention relates to a tiltable main nozzle mounting for air jet looms with reset elements to swing the main nozzle arrangement back into a base position

BACKGROUND INFORMATION

Such a tiltable main nozzle arrangement is already known from the German Patent Publication (DE-OS) No. 3,014,776.

The known main nozzle arrangement is mounted to be tiltable in two degrees of freedom which are independent of each other, whereby the rear part of the main nozzle arrangement is mounted tiltably in the vertical as well as in the horizontal direction.

The disadvantage of such an arrangement is that no defined reset force exists, that is, reset elements are missing to tilt the main nozzle arrangement, which is set to a certain position, back to a base position. Instead, this known main nozzle arrangement requires its own reset elements which act on the tilting part of the main nozzle arrangement as separate elements, resulting in considerable expense in manufacturing and maintaining such a main nozzle.

Another disadvantage of the known main nozzle arrangement is that the guide curves for tilting the main nozzle arrangement are determined by the tilting bearing itself. This has the disadvantage that the tilting bearing, particularly under extended operating periods, is subject to wear so that the entire tilting bearing has to be replaced, which involves relatively high expenditures.

OBJECTS OF THE INVENTION

It is an object of the present invention to further develop a tilting main nozzle arrangement of the above type so as to simplify its construction and to make its operation more reliable. Further, the position of the nozzle exits relative to the entrance of the weft thread air channel through the reed should be adjusted.

SUMMARY OF THE INVENTION

The invention teaches that the main nozzle arrangement is supported by an elastic, springy element on a nozzle holder connected to the weaving slay.

According to the invention the main nozzle arrangement is supported in a simply way opposite the weaving reed.

This construction offers several advantages:

First, placing a springy element between the main nozzle and the weaving slay, whereby this springy element is the only bearing point, offers the substantial advantage in that the reset force of this elastic bearing element is used to assure a defined weft insertion position.

Furthermore, such an elastic element, which functions as a reset element, is not subject to wear because there are no movable, mechanical parts. Hence, such an element has a long service life.

Basically, it does not make any difference where this reset element is connected to the main nozzle. However, vibrations are minimized if the elastic reset element supports the mass center of gravity of the main nozzle arrangement.

In a first preferred embodiment, the reset element is connected to the rear part of the main nozzle arrangement, that is, there is a rear support between the main nozzle arrangement and the weaving slay.

In another preferred embodiment, this flexible reset element is arranged to support approximately the center of the main nozzle arrangement.

In a third embodiment, this flexible reset element is placed so as to support the mass center of gravity, relative to the length of the main nozzle arrangement. This offers the advantage that, due to the vibration of the weaving slay, the main nozzle itself will vibrate only a little and be subjected to small twisting or torque forces that oppose an adjusting motion.

There are several possibilities for constructing the flexible reset element.

In a first preferred embodiment a simple leaf spring is connected with one of its ends to the weaving slay, for example through a holder and the other end of the leaf spring is connected to the main nozzle arrangement.

The leaf spring can thereby be arranged at various points of the main nozzle as a support, whereby the above described three possibilities are preferred.

The advantage of using a simple leaf spring is that the leaf spring has a direction bias. The leaf spring is torsionally elastic in the one desired direction, but rigid in the other undesired direction, that is, in the direction in which the main nozzle should not be moved.

The flat leaf spring can be constructed as a straight spring element or as a U-shaped spring element, or as an angled spring element.

Instead of using a straight bending spring or leaf spring, the invention may use flexible reset elements, such as rubber-, caoutchouc-, or synthetic-material elements, in another embodiment. These elastic reset elements are particularly inexpensive to manufacture and easy to replace in the case of wear, which, however, is not to be reckoned with.

A third embodiment combines rubber-, caoutchouc-, or other flexible elements with metal elements, which means rubber-metal bonded elements, whereby rubber molded parts or other elastic parts are bonded to the metal elements. The advantage of the latter mentioned elements is that they can be produced relatively inexpensively and still have a biased reset direction with a long service life.

The suggested elastic mounting of the main nozzle arrangement on the weaving slay has the advantage that now the nozzle exit or nozzle exits of the main nozzle arrangement, can move along desired paths, assuming appropriate drive elements are used which drive in the preferred direction.

It is hereby preferred that the nozzle exit or exits be guided within a guide path, whereby the guide path can have various shapes or forms.

Essential to this guide path is that defined limit stops are maintained so that the respective nozzle exits of a nozzle pipe bundle of the main nozzle arrangement can always be guided in a defined way in relation to the entrance of the air channel into which the weft threads are to be inserted.

If the main nozzle arrangement or the main nozzle bundle is to be moved along a desired profiled guide path, it is necessary that the drive is also correspondingly constructed.

In a first embodiment, the drive comprises two pneumatic piston cylinder devices, arranged mutually perpendicular, whereby the sliding displaceable part of the piston bears against a tilting part of the main nozzle bundle or rather its mounting element whereby the main nozzle bundle is moved accordingly, for example, along a curved path when air is admitted to the two cylinder piston devices.

Two air cylinders are also used if movement is desired in two mutually perpendicular directions. The two piston rods then move in mutually perpendicular directions.

Instead of the arrangement of two mutually perpendicular air cylinders, which are relatively difficult to control, another embodiment provides that one single air cylinder is used, which is guided on a corresponding guide path and thus, drives the main nozzle corresponding to the required guide path.

BRIEF DESCRIPTION OF THE DRAWINGS

The invention is explained below in more detail, based on several example embodiments, with reference to the accompanying drawings, wherein:

FIG. 9 is a view similar to FIGS. 2 and 3 showing a rubber elastic mounting member.

DETAILED DESCRIPTION OF PREFERRED EXAMPLE EMBODIMENTS AND OF THE BEST MODE OF THE INVENTION

Figures 1, 2, 3:
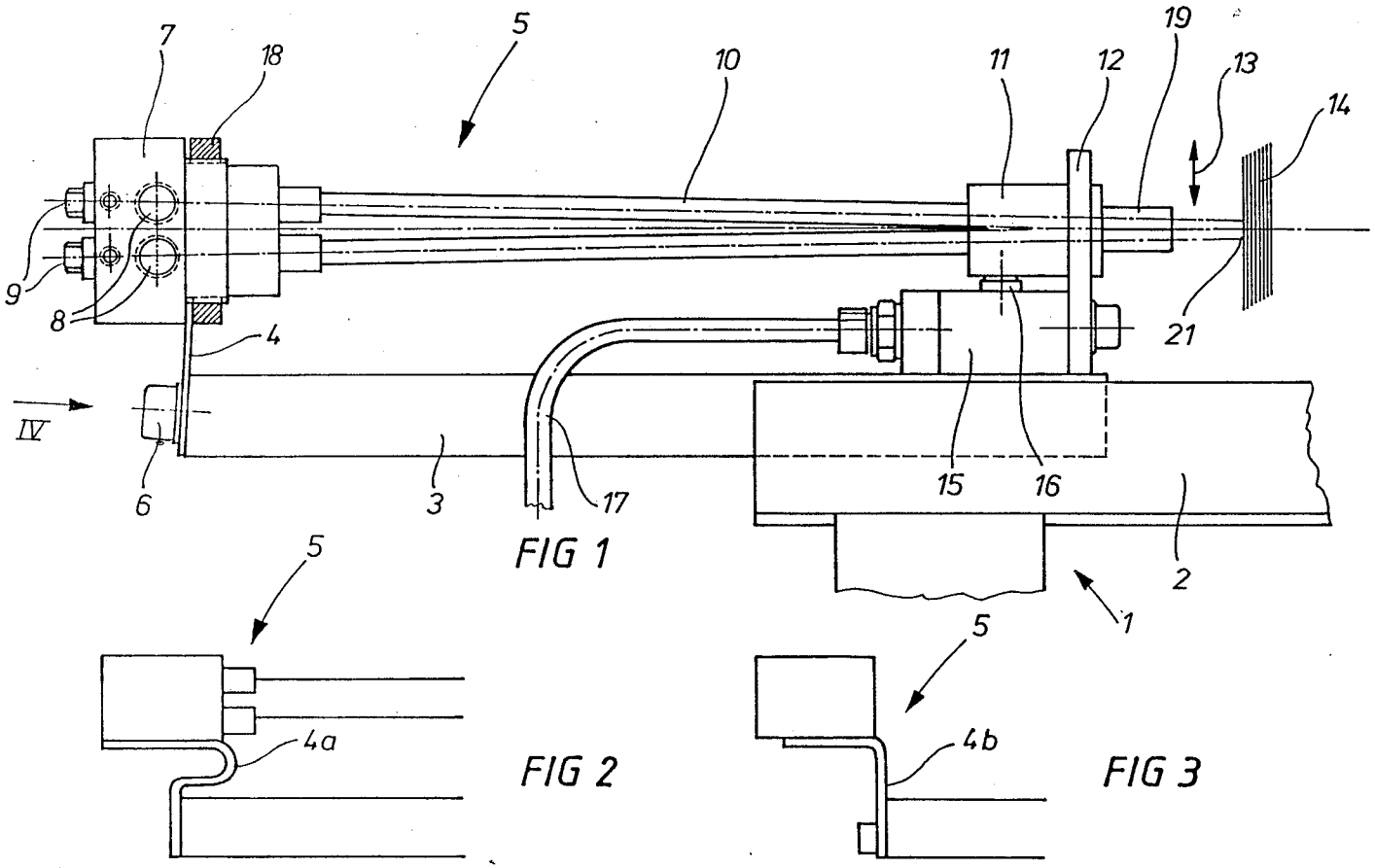
FIG. 1 shows schematically a side view of a first embodiment of a tiltably mounted main nozzle arrangement with a flat leaf spring as a mounting member.
FIG. 2 shows a further example embodiment of the spring mounting member.
FIG. 3 shows another modified example embodiment of the spring mounting member.

FIG. 1 shows a reed rod or reed stop 2 of a weaving slay 1, to which a nozzle holder 3, not described in detail, is secured. A bending spring 4, constructed as an elastic element, is attached by a screw 6 to the rear end of the nozzle holder 3.

Figure 4:
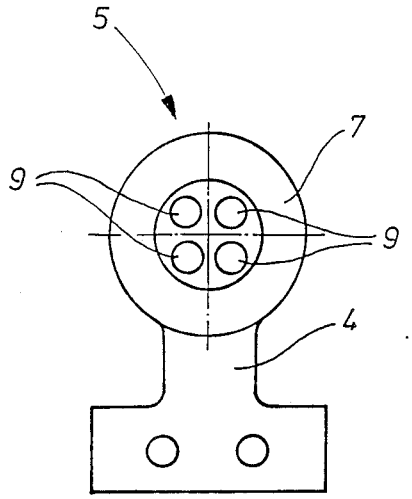
FIG. 4 shows the rear view of the main nozzle arrangement in the direction of the arrow IV in FIG. 1.

As seen in FIG. 4, the bending spring 4 is a simple bending spring. One end of the spring 4 is fixed with the help of the screws 6 to the rear end of the nozzle holder 3 and the other spring end is fastened by a clamping nut 18 to the housing 7 of the main nozzle arrangement 5.

The main nozzle arrangement 5 comprises a nozzle housing 7, with the nozzle cones 9 arranged on the rear side, plus laterally fitted air supply inlets 8, and a plurality of nozzle pipes 10.

The nozzle pipes 10 run from the nozzle housing 7 toward the reed, where they are bundled and held together by a guided mounting (11). FIG. 1 and FIGS. 5 to 8 show several different possibilities for movably supporting the guided mounting 11. Two nozzle pipes 10 are seen in FIG. 1. However, four nozzle pipes 10 with nozzle exits 19 are bunched together as shown in FIGS. 5, 6, 7, and 8.

The guided mounting 11 is movably guided within a guide recess 20 in a guide element 12, whereby the lower end of the guide element 12 is a rectangular part of synthetic material fastened to the nozzle holder 3.

A pneumatic piston cylinder device 15 having a piston rod 16 bearing against the lower side of the guided mounting 11, is fixed to the guide element 12. Movement of the piston rod 16 displaces the mounting 11 within the guide recess 20 for adjustment of the nozzle outlets 19 relative to the air channel 21 of the reed 14.

The pneumatic piston cylinder device 15 is supplied with control air through an air inlet 17.

It is important that the piston rod 16 is held in its retracted resting position by a spring located in the pneumatic piston cylinder device 15. The piston rod 16 is moved out against the spring force by admitting air through the air inlet 17, so that the nozzle exits 19 of the main nozzle are moved in an adjustment direction 13.

It is also important that the spring force of the bending spring 4 works against the adjusting movement of the piston rod 16, since this stabilizes the system. The guided mounting 11 always bears with a defined force against the piston rod 16, thus preventing damaging oscillations and vibrations of the system.

Thus, the weft threads can be carried with a high degree of precision by the nozzle exits 19 into the loom shed, namely into the air channel 21 formed by reed elements 14 indicated in FIG. 1.

FIG. 2 shows that a bending spring **4*a* has substantially a U-shape having one straight leg 4*b* secured to the nozzle housing 7 and a bent over leg 4*c* secured to the nozzle holder 3. FIG. 3 shows a bending spring 4*d*** bent at a right angle to have an L-cross-sectional configuration.

According to the invention the bending spring may be constructed as a spring having two legs of substantially equal length to form a U-or V-configuration.

Regarding the construction of the shape of the bending spring, the only essential aspect is, that the spring must provide a metal-elastic mounting if the bending spring is made of metal.

However, the bending spring 4 may be replaced by an elastic element, for example, a block or pad of synthetic material, caoutchouc, or rubber, which would also provide the required reset force opposite to the direction of adjustment 13. FIG. 9 shows such an embodiment with an elastic rubber block 22 secured between the housing 7 and the nozzle holder 3.

Furthermore, combinations of rubber and metal elements are possible for elastically mounting the nozzle housing 7 to the nozzle holder 3.

Damaging oscillations are effectively prevented if the bending spring 4 is arranged so that one spring end or rather a plane defined by one spring end passes through the mass center of gravity of the main nozzle arrangement 5. The spring 4 shown in FIG. 1 is arranged approximately in such a location which will, for example, depend on the number of nozzle pipes 10.

The mass center of gravity may be closer to where the nozzle pipes 10 exit from the nozzle housing 7 if more than four nozzle pipes 10 are used.

FIG. 4 shows the rear view of the main nozzle arrangement 5, whereby for identical parts in FIGS. 1 and 4 the same reference numbers are used.

Figure 5:
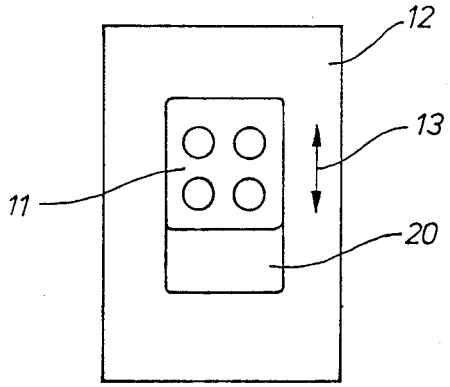
FIG. 5 shows the top or plan view onto a guide element of a first embodiment, with a guide recess for guiding a guided nozzle pipe mounting.

FIG. 5 shows a top or view of the mounting 11 guided in a guide recess 20 of the guide element 12. The recess 20 permits the guided movement of the mounting 11 in the directions of adjustment 13 up and down within the area of the guide recess 20.

Figure 6:
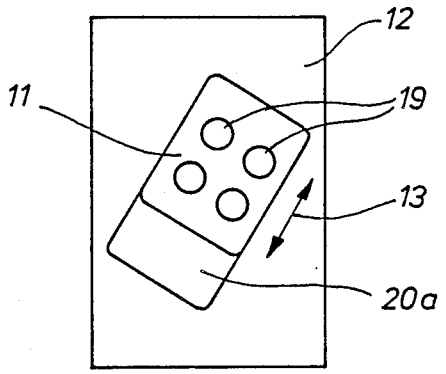
FIGS. 6, 7, 8 show modified example embodiments of the guide element of FIG. 5.

FIG. 6 shows that a guide recess 20*a* in the guide element 12 is arranged at a slant, so that the respective nozzle exits 19 can be guided along slanted paths defined by the guide recess 20*a* with the mounting 11 guided in the slanted recess 20*a* relative to the air channel 21 in the reed 14.

Figure 7:
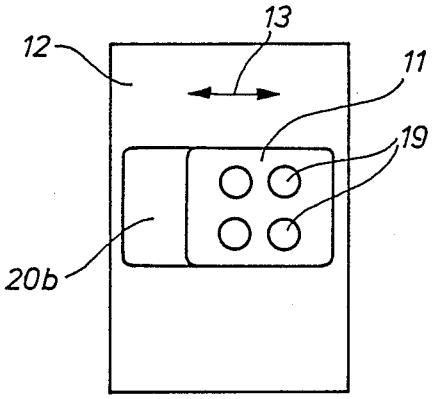
Figure 8:
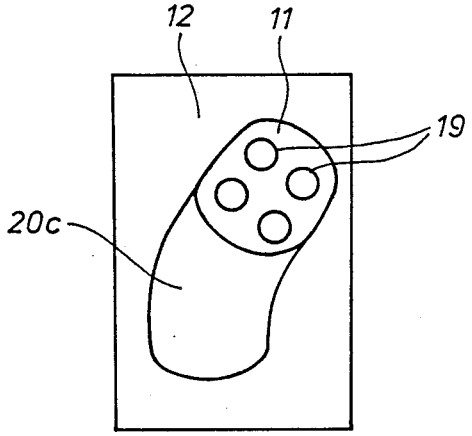

FIG. 7 shows a horizontal adjustment 13 of the guided mounting 11. FIG. 8 shows that the mounting 11 may be adjusted along an arch-shaped or curved guide recess 20*c*.

It follows from the entire description that the described mounting of a main nozzle arrangement 5 provides a reliable system which is resistant to wear and tear in its operation, is inexpensive to manufacture, and distinguishes itself by a long service life, especially since the number of the components required for the mounting has been reduced substantially.

Although the invention has been described with reference to specific example embodiments, it will be appreciated that it is intended to cover all modifications and equivalents within the scope of the appended claims.

We claim:

1. In an air jet loom having a reed (14) with a weft thread air insertion channel (21) and a slay (2), comprising a tiltable nozzle mounting for a main nozzle arrangement (5) including spring elastic means (4*a*, 4*d*, 22) for mounting a nozzle inlet end (7) where the weft thread is inserted into said main nozzle arrangement (5) to said slay (2) in such a manner that a nozzle exit end (19) of said main nozzle arrangement (5) is aimed at an entrance of said air insertion channel (21) of said reed (14) defining a weft thread insertion direction, guide means (11, 12, 20) connected to said nozzle exit end (19) for guiding aiming movements of said nozzle exit end along a defined path in any direction in a plane extending perpendicularly to said weft thread insertion direction as permitted by said spring elastic mounting means, and drive means (15, 16) connected to a guide member (11) of said guide means for moving said nozzle exit end along said defined path in an aiming adjustment.

2. The mounting of claim 1, wherein said member of said guide means comprises a mounting element (11) through which said nozzle exit end (19) extends, a guide element (12) mounted to said slay, and a cut-out guide path (20) in said guide element, said mounting element (11) passing through said cut-out guide path (20).

3. The mounting of claim 1, wherein said spring elastic mounting means have a spring bias for resetting said main nozzle arrangement into a base position when said drive means are not operated.

4. The mounting of claim 1, wherein said spring elastic mounting means comprise a flat metal spring having a spring characteristic that bends easier in an adjustment direction than in any other direction, one end of said flat metal spring being connected to said nozzle inlet end (7) of said main nozzle arrangement (5), the other end of said flat metal spring being connected to said slay (2, 3).

5. The mounting of claim 1, wherein said spring elastic mounting means comprises an elastic material block, one side of which is connected to said slay (2, 3), the other side of said block being secured to said nozzle inlet end (7) of said main nozzle arrangement.

6. The mounting of claim 1, wherein said drive means for said aiming adjustment comprise piston cylinder drive means (15, 16) including piston rod means (16) connected to said guide member (11) for moving said guide member for said aiming adjustment along said defined path.

* * * * *